US010646092B2

(12) United States Patent
Pfeiffer

(10) Patent No.: US 10,646,092 B2
(45) Date of Patent: May 12, 2020

(54) CLEANING DEVICE FOR ACTING UPON A SURFACE TO BE CLEANED

(71) Applicant: Vorwerk & Co. Interholding GmbH, Wuppertal (DE)

(72) Inventor: Matthias Pfeiffer, Stolberg (DE)

(73) Assignee: Vorwerk & Co. Interholding GmbH, Wuppertal (DE)

( * ) Notice: Subject to any disclaimer, the term of this patent is extended or adjusted under 35 U.S.C. 154(b) by 231 days.

(21) Appl. No.: 15/738,699

(22) PCT Filed: Jun. 1, 2016

(86) PCT No.: PCT/EP2016/062357

§ 371 (c)(1),
(2) Date: Dec. 21, 2017

(87) PCT Pub. No.: WO2016/206933

PCT Pub. Date: Dec. 29, 2016

(65) Prior Publication Data

US 2018/0177375 A1 Jun. 28, 2018

(30) Foreign Application Priority Data

Jun. 22, 2015 (DE) ..... 10 2015 109 952

(51) Int. Cl.
*A47L 11/40* (2006.01)
*A47L 11/00* (2006.01)
(Continued)

(52) U.S. Cl.
CPC ..... *A47L 11/4047* (2013.01); *A47L 11/00* (2013.01); *A47L 11/26* (2013.01); *A47L 11/28* (2013.01); *A47L 11/282* (2013.01); *A47L 11/40* (2013.01)

(58) Field of Classification Search
CPC ..... A47L 11/10; A47L 11/26; A47L 11/28; A47L 11/40; A47L 11/282; A47L 11/18;
(Continued)

(56) References Cited

U.S. PATENT DOCUMENTS 1,798,327 A 3/1931 Johnston
2,953,798 A 9/1960 Borie, Jr.
4,926,515 A * 5/1990 Lynn ..... A47L 13/11 15/257.3

FOREIGN PATENT DOCUMENTS

DE 20 2007 004 878 U1 8/2007
EP 2 436 296 A1 4/2012

OTHER PUBLICATIONS

International Search Report of PCT/EP2016/062357, dated Jul. 26, 2016.

* cited by examiner

*Primary Examiner* — Shay Karls
(74) *Attorney, Agent, or Firm* — Collard & Roe, P.C.

(57) ABSTRACT

The invention relates to a cleaning device, in particular a floor-cleaning device, comprising a cleaning unit which is at least partly covered by an endless cleaning element that can be rotated continuously in relation to a surface to be cleaned during the action upon a surface to be cleaned. In order to devise a cleaning device in which regeneration of the endless cleaning element is particularly comfortable, the cleaning unit comprises at least one first roller part which can be placed on the surface to be cleaned and a second roller part, the radius of curvature of a roller subsection of the first roller part being different from a radius of curvature of a roller subsection of the second roller part.

9 Claims, 3 Drawing Sheets

(51) Int. Cl.
*A47L 11/26* (2006.01)
*A47L 11/282* (2006.01)
*A47L 11/28* (2006.01)

(58) Field of Classification Search
CPC ..... A47L 11/14; A47L 11/292; A47L 11/22;
A47L 11/24; A47L 11/4047
See application file for complete search history.

CLEANING DEVICE FOR ACTING UPON A SURFACE TO BE CLEANED

CROSS REFERENCE TO RELATED APPLICATIONS

This application is the National Stage of PCT/EP2016/062357 filed on Jun. 1, 2016, which claims priority under 35 U.S.C. § 119 of German Application No. 10 2015 109 952.7 filed on Jun. 22, 2016, the disclosures of which are incorporated by reference. The international application under PCT article 21(2) was not published in English.

AREA OF THE INVENTION

The invention relates to a cleaning device, in particular to a floor cleaning device, with a cleaning unit at least partially covered by an endless cleaning element, which while acting on a surface to be cleaned can rotate continuously relative to the surface to be cleaned, wherein the cleaning device has at least one first roller part that can be placed on the surface to be cleaned and a second roller part, wherein a radius of curvature for a roller subsection of the first roller part is different from a radius of curvature for a roller subsection of the second roller part.

PRIOR ART

Cleaning devices of the aforementioned kind are known in prior art. For example, these can be wet cleaning devices, which as a cleaning unit have a wettable cleaning roller. The cleaning device can here basically be designed like a device controlled by a user, or as an automatically displaceable cleaning robot.

For example, publication DE 20 2007 004 878 U1 discloses a cleaning device for damp mopping floor coverings. The cleaning device has a cloth roller as the cleaning unit, which has a hollow body that can be wetted from inside and is covered by velour or microfiber fleece. This endless cleaning element takes up the entire periphery of the cloth roller, wherein rotating the cloth roller relative to the floor covering to be cleaned simultaneously causes the endless cleaning element to rotate.

In order to clean the cloth roller to remove the dirt picked up while acting on the floor surface, the cleaning device has a centrifuging function for self-cleaning the cloth roller, in which liquid is supplied to flush and centrifuge the outer roller.

The disadvantage here is that regenerating the endless cleaning element, i.e., centrifuging the dirty liquid, must take place during a regeneration process separate from the wiping action. As a consequence, regenerating the endless cleaning element requires that the wiping action be stopped and a regeneration process be performed, which could require an additional motor or drive to give the cleaning unit a high speed during the regeneration process.

Also known from prior art are cleaning units that have a first roller part that can be placed on the surface to be cleaned and a second roller part, wherein the radii of curvature for the roller parts are different. In this regard, for example, EP 2436296 A discloses a sweeping device with a dehumidifier comprised of a continuous wiping cloth, which is guided in a vertical plane around pulleys, driven by an electric motor. Publication U.S. Pat. No. 1,798,327 A discloses a scrubbing brush with a scrubbing element, which has an endless wiping cloth deflected by rollers. In addition, publication U.S. Pat. No. 2,953,798 A also discloses a surface treatment device with an endless cleaning cloth, which can be continuously rotated around a cleaning roller relative to a surface to be cleaned, wherein the cleaning cloth is further deflected by guide rollers with a smaller radius of curvature.

SUMMARY OF THE INVENTION

The object of the invention is to provide a cleaning device in which the regeneration of the endless cleaning element is optimized.

As a solution, the invention proposes a cleaning device in which at least one roller part is non-rotatably arranged inside of the cleaning unit.

The invention provides that at least one roller part be non-rotatably arranged inside of the cleaning unit. In this embodiment, the endless cleaning element is pulled into the area of this non-rotatable roller part by the roller part, thereby creating friction between the endless cleaning element and the roller part. If necessary, this friction can be used for additionally regenerating the endless cleaning element. In this conjunction, it can be provided that one roller part of the cleaning unit be non-rotatable, and another roller part be rotatable in design. Furthermore, all roller parts, i.e., two or more roller parts of the cleaning unit, can be non-rotatable, wherein the endless cleaning element is pulled around the roller parts by means of an additional driving attachment, so that the endless cleaning element can act on the surface to be cleaned.

Provided is a cleaning unit with two or more roller parts, which have different radii of curvature, so that when the roller parts rotate, the different radii of curvature result in deviating centrifugal forces acting on the dirty liquid in the area of these radii of curvature. Within the framework of the invention, different areas of one and the same roller can be understood as the first roller part and second roller part, or alternatively two separate roller parts connected by means of the endless cleaning element. Only one of the roller parts can advantageously be placed on the surface to be cleaned, so that while the endless cleaning element acts on the surface to be cleaned, there is only contact between the first roller part and the surface, for example, while the second roller part does not touch the surface to be cleaned. In this embodiment, the first roller part serves to act on the surface to be cleaned by means of the endless cleaning element contacting the surface, while the second roller part serves to regenerate the endless cleaning element. Since the endless cleaning element involves an element that continuously rotates around the two roller parts, for example an endless wiping cloth, a second endless cleaning element subsection can be regenerated on the second roller part at the same time that a first endless cleaning element subsection acts on the surface to be cleaned. As opposed to prior art, it is thus not necessary to interrupt any action being taken on the surface to be cleaned, i.e., the cleaning process, for regeneration purposes. Rather, the action (wiping) and regeneration can take place simultaneously. In addition, it is not necessary to allocate a drive that can provide two different speeds to the cleaning unit, specifically a first speed for acting on the surface to be cleaned and a second speed for regenerating the endless cleaning element. Instead, the dirty liquid in the area of the second roller part is centrifuged by the differently dimensioned radii of curvature for the first and second roller part, wherein the second radius of curvature for the second roller part is smaller than the radius of curvature for the first roller part, so that a higher centrifugal force acts on the dirty liquid in the area of the first roller part than in the area of the first roller part.

At least one roller part is advantageously rotatably arranged inside of the cleaning unit. This configuration causes the endless cleaning element to roll over the periphery of the roller part while the cleaning unit rotates. This makes it easier to convey the endless cleaning element from the first roller part to the second roller part and back in a friction-reducing manner, so that each endless cleaning element subsection can recurrently pick up dirt and release dirt. The roller part can either be actively driven by an electric motor, or passively entrained by a movement of the endless cleaning element. In the latter case, the endless cleaning element is moved by an electric motor allocated to the other roller part or an electric motor separate from the roller parts. A first roller part is advantageously actively driven, while a second roller part is made to co-rotate passively by the rotation of the endless cleaning element.

It is proposed that the cleaning unit be designed as a traction mechanism drive, wherein the roller parts are shafts spaced apart from each other, which are connected with each other by the endless cleaning element so as to transmit torque. As a consequence, the cleaning unit is designed like a traction mechanism drive, wherein the torque of an actively driven roller part is transmitted to another roller part of the cleaning unit, which thereupon passively co-rotates. The torque is transmitted by the endless cleaning element, which is placed over the peripheral surfaces of the roller parts, so that both roller parts are located inside of the area bordered by the endless cleaning element. This configuration especially advantageously combines the driving of a second roller part by means of a first roller part, and simultaneously the picking up of dirt or dirty liquid in the area of the first roller part or vice versa. A continuous regeneration mode simultaneously accompanied by acting on the surface to be cleaned is thus possible during a conventional operation. Since the traction mechanism drive has two different-sized roller parts as shafts in the invention, the centrifugal force on the larger, first roller part is less than on the second, smaller roller. The speed of the cleaning unit, and hence also the speed of the endless cleaning element, can be selected in such a way that no liquid is centrifuged in the area of the first roller part that serves to act on the surface to be cleaned, while a higher centrifugal force attacks the dirty liquid in the area of the second, smaller roller part, so that it is centrifuged by the endless cleaning element.

It is proposed that the roller parts be non-rotatably, in particular integrally, joined together. In this embodiment, the roller parts are joined together directly, and not just via the endless cleaning element. In particular, the roller parts involve subsections of one and the same roller. This roller is here designed in such a way that the individual areas, i.e., the roller parts, have radii of curvature that differ from each other, so as to ensure a change in centrifugal force on the different roller parts. In this embodiment, the roller parts are non-rotatable to each other, wherein the endless cleaning element is moved relative to the one-piece roller. According to the invention, the endless cleaning element here moves over the differing roller parts with varying radii of curvature, so that the centrifugal force acting on the dirty liquid causes the dirty liquid to be centrifuged in the area of the second roller part (with a smaller radius of curvature).

It is further provided that the endless cleaning element can be displaced relative to the cleaning unit, in particular, conveyed by means of at least one motor-driven roller part. In this embodiment, the endless cleaning element can be displaced independently of a movement by the roller parts, so that the endless cleaning element can be conveyed even given roller parts that are non-rotatably arranged inside of the cleaning unit. However, it is especially advantageous for one of the roller parts to be motor-driven.

It is proposed that the endless cleaning element be stretched over the roller parts, wherein the cleaning unit in particular has a tensioning device that exerts a spring force on the endless cleaning element. Tensioning the endless cleaning element allows a torque to be transmitted between roller parts. Since the endless cleaning element in most cases also consists of a flexible material, for example a fleece or the like, it is advantageous to continuously exert a spring force on the endless cleaning element. The cleaning unit thus advantageously has a tensioning device that exerts this spring force on the endless cleaning element. For example, the tensioning device can be allocated to a roller part by shifting the rotational axis of the roller part in such a way that the endless cleaning element is always exposed to tension. This is beneficial on the one hand for endless cleaning elements that are subject to a loss of internal stress over the course of their service life, or on the other hand for roller parts that have different radii of curvature along their periphery, so that the endless cleaning element would be tensioned at times more and other times less absent such a tensioning device.

It is further proposed that the radius of curvature for the first roller part be two to twenty times, in particular ten to fifteen times, larger than the radius of curvature for the second roller part. The more the radii of curvature for the roller parts differ, the more clearly the action of the first roller part without any dispensing of liquid can be differentiated from the regeneration process of the endless cleaning element on the second roller part. The correlation between the radii of curvature makes it possible to set the relationship between the centrifugal forces acting on the respective roller parts, which simultaneously leads to the adhesion or centrifuging of dirty liquid in the area of the respective roller parts. The 10:1 to 15:1 radii of curvature described as especially advantageous have proven to be especially advantageous in practice.

It is further proposed that the roller part be round or drop-shaped. For example, a roller part of the cleaning unit can here be circular in design relative to the cross section, while a second roller part is drop-shaped in design, and thus changes the radius of curvature along its periphery. The drop-shaped second roller part can here have a radius of curvature relative to one of its roller subsections that corresponds to the radius of curvature for the first roller part, while another roller subsection of the drop-shaped second roller part has a radius of curvature that is smaller than the radius of curvature for the first roller part. In this embodiment, dirty liquid is centrifuged in the tapered area of the drop shape, which has the smaller radius of curvature. As a result, dirty liquid is not continuously centrifuged in the area of the second roller part, but rather only when the endless cleaning element gets into the area of the tapered drop tip. The cleaning unit is here advantageously designed in such a way that the endless cleaning element always tautly abuts against the roller parts regardless of the current orientation of the drop shape, so that the endless cleaning element can rotate. If necessary, a difference in length of the peripheries can advantageously be offset by the tensioning device described above.

Finally proposed is that the second roller part have at least one action element that mechanically acts on the endless cleaning element to clean the endless cleaning element. The mechanical action element is used to support the regeneration of the endless cleaning element on the second roller part. The action element is advantageously arranged on the periphery of the second roller part, so that the latter acts on the endless cleaning element while the endless cleaning element is displaced relative to the second roller part. For example, the action element can be a nap structure of the surface of the second roller part or the like. As a consequence, regeneration involves not only the centrifuging of dirty liquid via centrifugal forces, but rather also the mechanical effect of the action elements on the endless cleaning element.

BRIEF DESCRIPTION OF THE DRAWINGS

The invention will be described in more detail below based on exemplary embodiments. Shown on.

DESCRIPTION OF THE EMBODIMENTS

Figure 1:
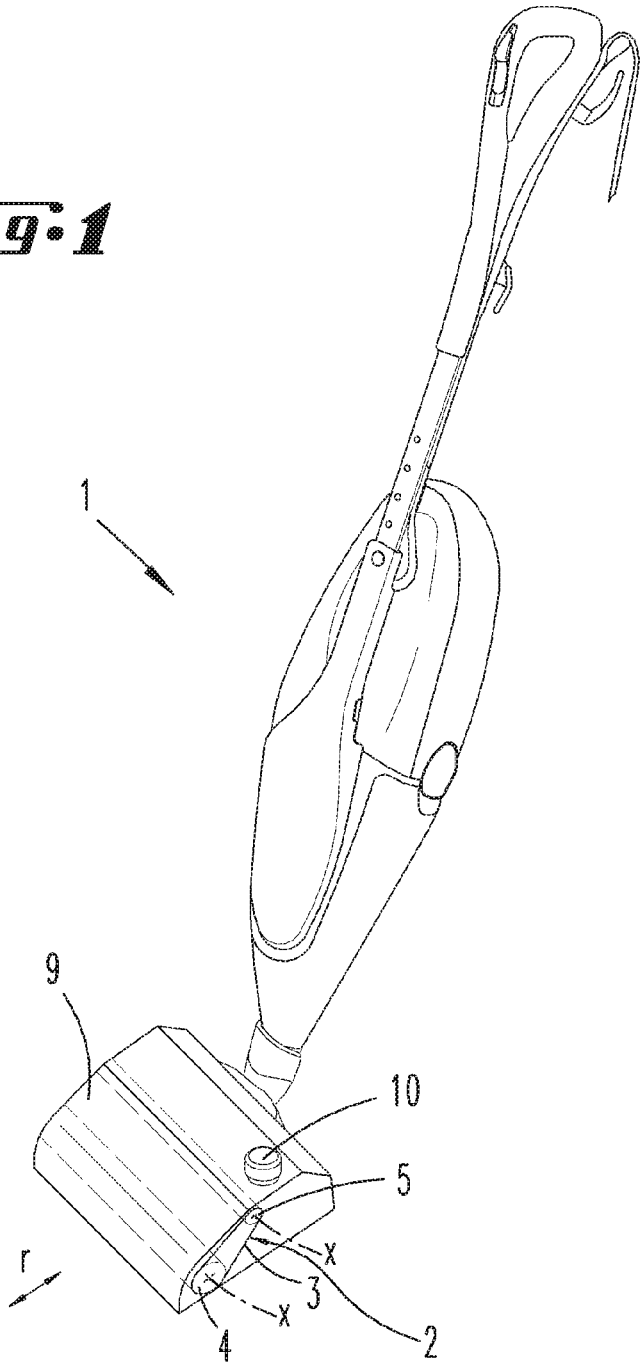
FIG. 1 is a cleaning device according to the invention.

Shown and described first with reference to FIG. 1 is a cleaning device 1 in the form of a wet cleaning device for wet cleaning a surface to be cleaned. The cleaning device 1 has an attachment 9, which is in contact with the surface to be cleaned during a cleaning process. The attachment 9 has a cleaning unit 2 comprised of two roller parts 4, 5 designed separately from each other, as well as an endless cleaning element 3 designed as an endless cloth. The endless cleaning element 3 is wrapped around the two roller parts 4, 5, so that it can circulate from the first roller part 4 to the second roller part 5 and back while the roller parts 4, 5 rotate around a respective rotational axis x. The cleaning device 1 is supported on the surface to be cleaned by way of the first roller part 4. The second roller part 5 is not in contact with the surface to be cleaned, but rather is offset inside of the attachment 9 in such a way as to preclude contact. The roller parts 4, 5 extend transverse to a conventional traversing direction r of the cleaning device 1, which results from the usual working movement of a user of the cleaning device 1, specifically generally alternatingly to and fro, possibly further accompanied by a slight swerving into an adjacent cleaning path. The roller parts 4, 5 extend approximately over the entire width of the cleaning device 1 standing transverse to the traversing direction r. In the arrangement shown, a respective roller part 4, 5 is located at the front or back of the attachment 9 as the cleaning device 1 moves in the traversing direction r. At least one of the roller parts 4, 5 can be driven by an electric motor, i.e., rotated around its rotational axis x.

The attachment 9 has a tank for holding liquid for cleaning the surface to be cleaned. The liquid can be filled into the tank of the attachment 9 via a filler 10. The endless cleaning element 3 can be moistened with the liquid either from inside by at least one roller part 4, 5, or by spraying the liquid onto the roller part 4, 5 from outside.

During a conventional traversing process of the cleaning device 1 in which a surface to be cleaned is not processed, the cleaning unit 2 is not actively driven. Rather, just the frictional connection to the surface to be cleaned itself makes the roller parts 4, 5 passively rotate, but this does not produce a centrifugal force large enough for centrifuging the dirty liquid. During the process of cleaning the surface with the first roller part 4, at least one of the roller parts 4, 5 is actively driven by means of the electric motor. During the cleaning process, a wiping edge arises along the line of contact between the first roller part 4 and the surface to be cleaned. This wiping edge takes over the cleaning of the surface by being moved relative to the surface, thereby loosening dirt and conveying it on the endless cleaning element 3 in the area of the first roller part 4.

Figure 2:
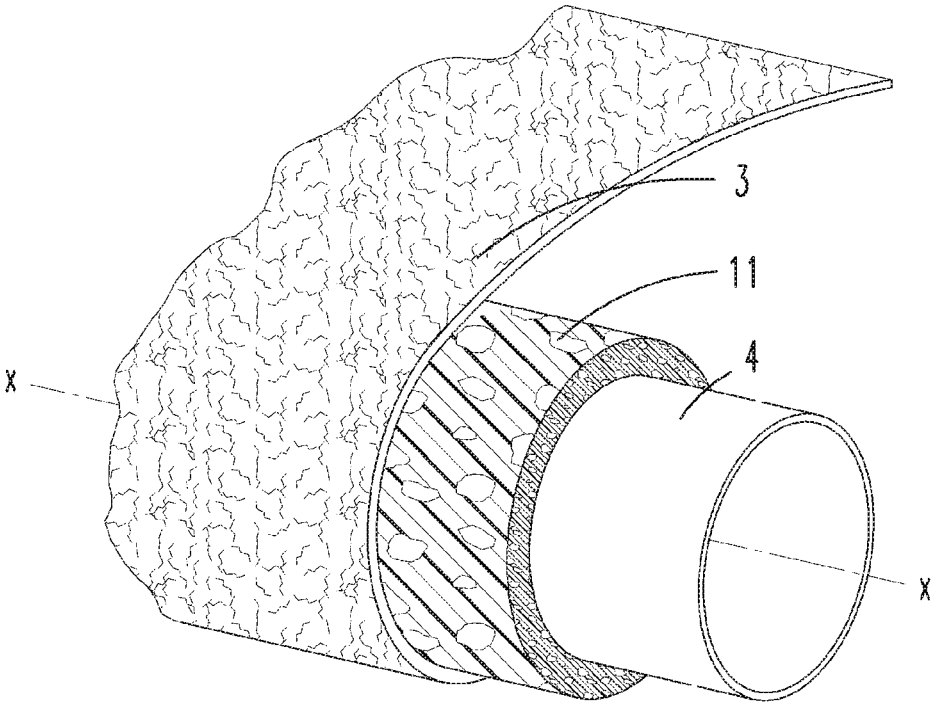
FIG. 2 is an exploded view of a cleaning unit according to the invention.

FIG. 2 shows a detailed view of the first roller part 4 of the cleaning unit 2. The first roller part 4 is here shown in an exploded view relative to its various sheaths. The first roller part 4 is basically designed as a cylindrical hollow body sealed on the front side, wherein the front seal is not depicted to provide an improved view. Alternatively, the first roller part 4 can also be designed as a massive body. The first roller part 4 is enveloped by a sponge body non-rotatably arranged thereon. The sponge body 11 has an open-pored design, and is capable of temporarily storing liquid. The sponge body 11 is covered at least partially by the endless cleaning element 3, which connects the first roller part 4 with the second roller part 5. The endless cleaning element 3 is here designed as a microfiber cloth. As opposed to the sponge body 11, the latter is rotatably arranged inside of the cleaning unit 2, so that the subsection of the endless cleaning element 3 abutting against the sponge body 11 is changed through circulation. As soon as the sponge body 11 and/or the endless cleaning element 3 is exposed to liquid, the cleaning unit 2 is pressurized by shifting the cleaning device 1 onto the surface to be cleaned, and thereby dispenses liquid onto the surface to be cleaned. In the process, liquid exits in the area of the wiping edge of the first roller part 4. The liquid is here squeezed out of the sponge body 11 and/or endless cleaning element 3 and applied to the surface to be cleaned. As the cleaning unit 2 continues to rotate in the traversing direction r of the cleaning device 1, dirt is loosened from the surface to be cleaned and transferred to the endless cleaning element 3.

Figure 3:
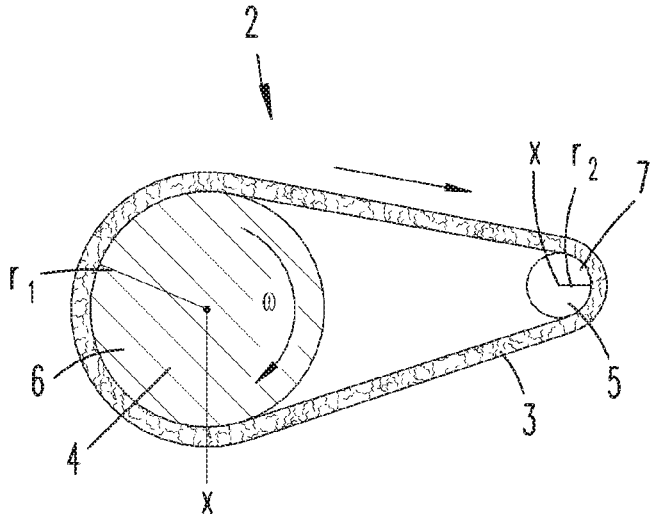
FIG. 3 is a side view of a cleaning unit according to a first embodiment.

FIG. 3 shows a first embodiment of a cleaning unit 2 according to the invention. The cleaning unit 2 has a first roller part 4 and a second roller part 5. Both roller parts 4, 5 are designed as cylindrical roller parts 4, 5, which have a constant radius of curvature $r_1$, $r_2$ over their periphery. The first roller part 4 here has a radius of curvature $r_1$, which is the same size in all roller subsections 6. The second roller part 5 also has a radius of curvature $r_2$ whose size is also the same in all roller subsections 7. The radius of curvature $r_1$ for the first roller part 4 is here roughly three times larger than the radius of curvature $r_2$ for the second roller part 5. Both the first roller part 4 and second roller part 5 are mounted so that they can rotate around their respective rotational axis x. The endless cleaning element 3 is draped over the roller subsections 6, 7 of the roller parts 4, 5, wherein the cleaning unit 2 as a whole forms a traction mechanism drive, in which the first roller part 4 can be actively, driven by an electric motor, and the second roller part 5 is made to passively co-rotate by the transmission of torque from the first roller part 4 to the second roller part 5. The rotation of the first roller part 4 around the rotational axis x displaces the endless cleaning element 3 relative to the cleaning unit 2, as a result of which a different subsection 6 of the first roller part 4 always lies on the surface to be cleaned when the cleaning unit 2 acts on the surface to be cleaned. Rotating the first roller part 4 causes a centrifugal force to act on the liquid, which is stored in this area or on the endless cleaning element 3. However, due to the diameter $r_1$ of the first roller part 4, the centrifugal force acting on the liquid (at a defined rotational speed ω) is not large enough to centrifuge the dirty liquid out of the endless cleaning element 3. By continuously conveying the endless cleaning element 3 from the first roller part 4 to the second roller part 5 and back again, the area of the endless cleaning element 3 that previously abutted against the first roller part 4 gets into the area of the second roller part 5, which has the smaller radius of curvature $r_2$. As a result of this smaller radius of curvature $r_2$, the centrifugal force acting on the dirty liquid increases in the area of the second roller part 5, so that the liquid can be centrifuged in the corresponding area of the endless cleaning element 3. A corresponding housing part is advantageously provided inside of the cleaning device 1 for catching the centrifuged dirty liquid, so that the user does not come into contact with the dirty liquid, and no dirty liquid can drip onto the surface to be cleaned either.

Figure 4:
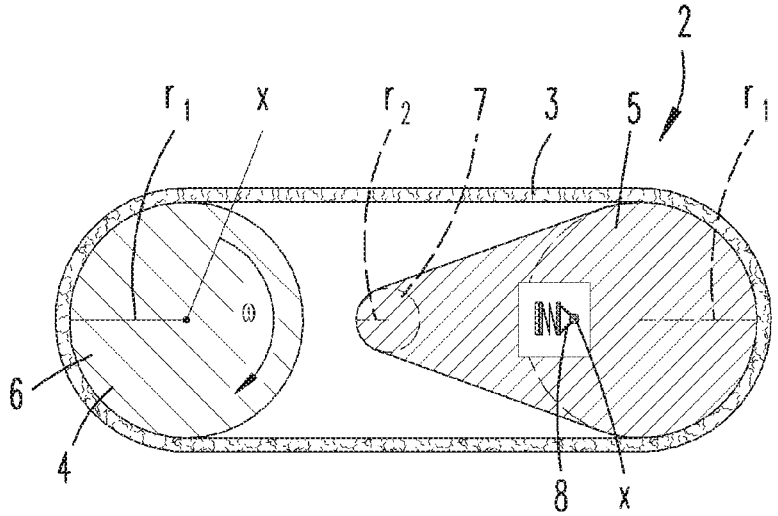
FIG. 4 is a side view of a cleaning unit according to a second embodiment in a first position.
Figure 5:
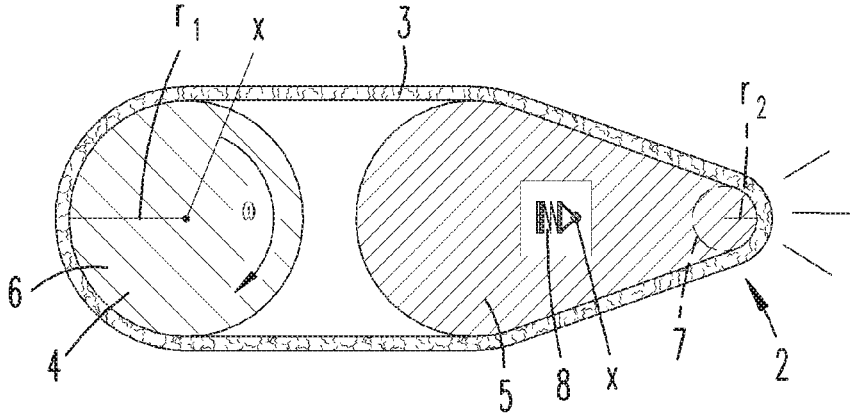
FIG. 5 is the cleaning unit according to FIG. 4 in a second position.

FIGS. 4 and 5 show a second embodiment of a cleaning unit 2 according to the invention, in which the second roller part 5 is drop-shaped in design. As the conveying process continues, this causes the endless cleaning element 3 at one time to abut against the tip of the drop shape, which has a smaller radius of curvature $r_2$ relative to the radius of curvature $r_1$ for the first roller part, and at another time against the opposing subsection of the drop shape, which has a radius of curvature $r_1$ that corresponds with the radius of curvature $r_1$ of the first roller part 4. Due to this configuration, the liquid stored in the endless cleaning element 3 is not continuously centrifuged in the area of the second roller part 5, but rather only when the endless cleaning element 3 happens to abut against the tip of the drop shape with the radius of curvature $r_2$ (see FIG. 5). In order for the endless cleaning element 3 to here always abut against the first roller part 4 and second roller part 5 in a tensioned state, the second roller part 5 has a tensioning device 8, which exposes the second roller part 5 to a spring force relative to its rotational axis x. The tensioning device 8 has a spring whose restoring force attempts to displace the second roller part 5 from the rotational axis x toward the endless cleaning element 3, wherein the endless cleaning element 3 always remains tensioned, regardless of the current orientation of the drop shape.

The embodiments of the invention shown on FIG. 3 or 4 and 5 only represent exemplary embodiments. Of course, the cleaning unit 2 can also have differently configured roller parts 4, 5. For example, the roller parts 4, 5 can be non-rotatably joined together as an integral roller. The roller parts 4, 5 here advantageously take the form of a drop (similar to FIGS. 4 and 5), thereby providing a larger radius of curvature $r_1$ on the one hand and a comparatively smaller radius of curvature $r_2$ on the other. The endless cleaning element 3 can here be pulled over the surface of the roller parts 4, 5 by means of an electric motor, creating a frictional force between the endless cleaning element 3 and roller parts 4, 5.

REFERENCE LIST

1 Cleaning device
2 Cleaning unit
3 Endless cleaning element
4 First roller part
5 Second roller part
6 Roller subsection
7 Roller subsection
8 Tensioning device
9 Attachment
10 Filler
11 Sponge body
r Traversing direction
x Rotational axis
ω Rotational speed
$r_1$ Radius of curvature
$r_2$ Radius of curvature

The invention claimed is:

1. A cleaning device (1), in particular a floor cleaning device, with a cleaning unit (2) at least partially covered by an endless cleaning element (3), which while acting on a surface to be cleaned can rotate continuously relative to the surface to be cleaned, wherein the cleaning unit (2) has a first roller part (4) that can be placed on the surface to be cleaned and a second roller part (5), wherein the endless cleaning element (3) is stretched exclusively over the first roller part (4) and the second roller part (5) without contacting any other structures of the cleaning device, wherein a radius of curvature ($r_1$) for a roller subsection (6) of the first roller part (4) is different from a radius of curvature ($r_2$) for a roller subsection (7) of the second roller part (5), wherein at least one roller part (4, 5) is non-rotatably arranged inside of the cleaning unit (2).

2. The cleaning device (1) according to claim 1, wherein at least one roller part (4, 5) is rotatably arranged inside of the cleaning unit (2).

3. The cleaning device (1) according to claim 1, wherein the cleaning unit (2) is designed as a traction mechanism drive, wherein the roller parts (4, 5) are shafts spaced apart from each other, which are connected with each other by the endless cleaning element (3) so as to transmit torque.

4. The cleaning device (1) according to claim 1, wherein the roller parts (4, 5) are non-rotatably, joined together.

5. The cleaning device (1) according to claim 1, wherein the endless cleaning element (3) is configured to be displaced relative to the cleaning unit (2).

6. The cleaning device (1) according to claim 1, wherein the cleaning unit (2) has a tensioning device (8) that exerts a spring force on the endless cleaning element (3).

7. The cleaning device (1) according to claim 1, wherein the radius of curvature ($r_1$) for the first roller part (4) is two to twenty times larger than the radius of curvature ($r_2$) for the second roller part (5).

8. The cleaning device (1) according to claim 1, wherein each of the roller parts (4, 5) is round or drop-shaped.

9. The cleaning device (1) according to claim 1, wherein the second roller part (5) has at least one action element that mechanically acts on the endless cleaning element (3) to clean the endless cleaning element (3).

* * * * *